United States Patent [19]

Kalenak et al.

[11] Patent Number: 4,832,223

[45] Date of Patent: May 23, 1989

[54] CONTAINER CLOSURE WITH INCREASED STRENGTH

[75] Inventors: Robert D. Kalenak; Stanley E. Dierking, both of Golden, Colo.

[73] Assignee: Ball Corporation, Muncie, Ind.

[21] Appl. No.: 130,257

[22] Filed: Dec. 8, 1987

Related U.S. Application Data

[63] Continuation-in-part of Ser. No. 75,384, Jul. 20, 1987.

[51] Int. Cl.[4] ..... B65D 8/08

[52] U.S. Cl. ..... 220/66; 220/67; 413/8

[58] Field of Search ..... 220/66, 67; 413/8

[56] References Cited

U.S. PATENT DOCUMENTS

| | | | |
|---|---|---|---|
| 3,406,866 | 10/1968 | Jasper | 220/54 |
| 3,441,170 | 4/1969 | Khoury | 220/66 X |
| 3,774,801 | 11/1973 | Gedde | 220/66 |
| 3,894,652 | 7/1975 | Brown | 220/270 |
| 4,027,612 | 6/1977 | Herbst | 113/121 C |
| 4,031,837 | 6/1977 | Jordan | 113/121 C |
| 4,109,599 | 8/1978 | Schultz | 113/121 C |
| 4,215,795 | 8/1980 | Elser | 220/67 X |
| 4,254,890 | 3/1981 | Westphal | 220/67 X |
| 4,354,784 | 10/1982 | Westphal | 413/12 |
| 4,448,322 | 5/1984 | Kraska | 220/66 X |
| 4,577,774 | 3/1986 | Nguyen | 220/66 |
| 4,606,472 | 8/1986 | Taube et al. | 220/67 X |

*Primary Examiner*—Steven M. Pollard

*Attorney, Agent, or Firm*—Gilbert E. Alberding

[57] ABSTRACT

A metal closure for a container includes a center panel, a center-panel ring with a convex curved surface, and an inner leg. The metal closure is provided with a band formed by at least coining to increase the buckling pressure. The band is defined as one of intersecting strain fields. The coining cold-works a total uncoined curvilinear length that includes a portion of the center-panel ring, and that optionally includes a portion of the center panel and/or a portion of the inner leg. In one embodiment, the coining produces two frustoconical coined surfaces. In another embodiment, the coining produces a curvilinear coined surface with a generally constant coin residual.

61 Claims, 6 Drawing Sheets

CONTAINER CLOSURE WITH INCREASED STRENGTH

BACKGROUND OF THE INVENTION

1. Field of the Invention

This is a continuation-in-part of our pending patent application Ser. No. 75,384, filed July 20, 1987.

The present invention relates to closures for metal beverage containers. More particularly the present invention relates to container closures having increased strength.

2. Description of the Prior Art

Metal beverage containers are a very competitive product in the packaging industry since the annual production of these containers is well over 70 billion per year in the United States alone. Even a small reduction in the thickness of the metal used in the container closure can result in savings of millions of dollars annually.

The closures for the containers typically include a center panel that is generally planar, a center-panel ring that is disposed annularly around the center panel and that curves downwardly therefrom, an inner leg that projects downwardly from the center-panel ring, a curved connecting portion that connects to the inner leg distal from the center-panel ring, an outer leg that connects to the curved connecting portion and that extends upwardly, and an outer curl that is used for double seaming to the container.

One of the limitations in the strength of a container of this type is the internal pressure at which buckling of the closure occurs. The value of this pressure is defined as the buckle strength of said closure. Buckling refers to a permanent and objectionable deformation of the closure, including the inner leg, the outer leg, and the center panel, in which circular uniformity of the closure is destroyed by fluid pressure that is exerted inside the closure. The buckle strength of a given closure is a measure of the resistance of the closure to failure by buckling.

Various attempts have been made to increase the buckle strength of container closures; and these attempts are represented by issued patents which are discussed below.

Gedde, in U.S. Pat. No. 3,774,801, teaches a complex doming of the center panels as a method of increasing the buckle strength of the closures.

Khoury, in U.S. Pat. No. 3,441,170, teaches coining of the inside of the center-panel ring as a method of allowing the center panel to dome under pressure without this doming exerting a full buckling force on the inner and outer legs of the closure, and thereby also preventing the buckling from breaking the seal between the container closure and the sidewall. The inventor states that the coined area functions as a hinge.

Jordan, in U.S. Pat. No. 4,031,837, teaches increasing the buckling strength by reforming the closure with a reduced radius in the curved-connecting portion that interconnects the inner and outer legs, by increasing the angle of the inner leg to substantially vertical, and by moving the curved-connecting portion downwardly from the center panel.

Kraska, in U.S. Pat. No. 4,217,843, teaches a reforming operation in which the inner and outer legs are positioned more nearly vertical, the inside radius of the center-panel ring is reduced, and the inside radius of the center-panel ring is coined to produce doming of the center panel by stretching the metal in the central-panel portion.

Some doming of the center panel has been found to increase the buckle strength of the containers because it eliminates any excess metal that results from scoring for the pull-tab opener. The patentee discloses that the doming removes all excess metal and in fact stretches the metal in the central-panel portion.

The prior art includes the Nguyen patents, viz., U.S. Pat. Nos. 4,434,641 and 4,577,774, both of common ownership to the present invention. In these patents, Nguyen teaches coining the convex outside surface of the center-panel ring to increase the buckling strength of the container closures.

As taught by Nguyen, coining is a local deformation, or cold-working of metal by reduction of thickness in a specified and limited, or predetermined, area through a single mechanical pressing operation, usually in the conversion press, that is preformed on the outside portion of the closure.

The coining produces compression doming of the center panel. Optionally, this doming is limited by providing a hold-down pad, as taught by Nguyen in the aforesaid prior art patents.

SUMMARY OF THE INVENTION

In the present invention, improved strength is provided in a container closure of the type which includes a center panel being disposed orthogonally to a container axis and having an outer perimeter, a center-panel ring being disposed perimetrically around the center panel and having a convex outer surface with a curvature that bends downwardly and that includes an uncoined arcuate length, an inner leg that extends downwardly from the center-panel ring, a connecting portion that curves upwardly and that includes a concave radius on the public side of the closure, an outer leg that extends upwardly from the connecting portion, and an outer curl that curls outwardly and downwardly and that is used for double seaming the closure to the sidewall of a container.

In a preferred embodiment of the present invention, one portion of the convex surface of the center-panel ring is coined at one angle to the container axis, thereby cold-working one frustoconical coined surface having a first perimetrical area; and another portion of the convex surface is coined at a different angle to the container axis, thereby cold-working another frustoconical coined surface having a different perimetrical area.

By controlling the coin angles, by controlling the difference in the coin angles between the first and second coins, and by controlling the thickness of residual metal after coining, a significant increase in buckling strength is achieved. This significant increase in buckling strength is thought to be as a result of the formation of a band of intersecting strain fields and also an increase in material hardness and tensile strength that is a result of cold-working.

The present invention achieves greater buckling pressures than container closures that are not coined; and the present invention achieves greater buckling pressures than has been achieved by coining such as is taught by the prior art.

This improvement in buckling pressures has been achieved by coining a radially-disposed total curvilinear length of the outer surface of the closure which is greater than can be achieved by coining a single frustoconical coined surface, as is done by Nguyen in U.S.

Pat. Nos. 4,434,641 and 4,577,774. This larger curvilinear length may include a portion of the center panel and/or a portion of the inner leg, as well as including most, or all, of the center-panel ring.

In Nguyen, the cross-sectional area of the material that has been cold-worked is defined by a chord that is disposed at a given distance from the inner radius of the center-panel ring. The present invention cold-works a volume of material whose cross-sectional area is greater than the cross-sectional area as defined by the aforesaid chord.

It is believed that the present invention achieves greater buckling strength by forming a narrow band of intersecting strain fields in the metal between and beneath the two cold-worked surfaces. This narrow band results in a strengthening device encircling the center panel. The band itself is characterized by a zone of intersecting deformation developed by separate steps, either serially or concurrently, of cold-working at more than one angle or direction to the container axis, and which differ from the surrounding metal by orientation and configuration of the mechanical texture extant in metal stock that has been subjected to drawing or rolling.

Mechanical texture (or fiber texture) is the observed effect of the alignment of inclusions, cavities, second phase constituent particles, and possible lattice bending and fragmentation due to alignment of crystallographic slip planes in the main direction of mechanical drawing or rolling. Texturing or fibering is an important factor in producing typical mechanical properties in such metals.

It was surprising to discover the phenomenal resistance to buckling provided by the present invention over that of the closure structures of the prior art and, although a satisfactory reason for this is still to be fully elucidated and it is to be assumed that the subject invention is not to be restricted thereby, it is here postulated that the acts of creating the aforementioned band results in a mechanical strengthening device of major significance comprising a zone or zones of overlapping deformations of fundamentally different directions. Within said band the symmetry of the mechanical texture or continuity with respect to the surrounding metal has been altered. Referring to FIG. 7, the region labelled X depicts mechanical texturing in a portion of the closure that has not been subjected to cold-work by coining, region Y depicts mechanical texture of that portion of the closure that has been cold-worked by coining in only one direction (or at only one angle to the container axis), and region Z shows the band wherein the symmetry of texture is altered by the strain fields created as a result of coining in more than one direction. This band is thought to afford different properties from the uncoined metal and from metal that has been cold-worked in only one direction when subjected to fluid pressures and, thus, confers resistance to buckling by impeding additional uniform deformation of the closure. This effect may be due to the elimination or reduction of metal anisotropy in the band in which the continuity of the usual mechanical texture has been significantly altered. The subject invention is found applicable to a wide range of metals, particularly those exhibiting mechanical texture.

Additionally, the metal in the coined regions, including the band, i.e., the zone of intersecting strain fields, is thought to be harder and to have a higher tensile strength than that in uncoined regions due to mechanisms of work-hardening. It is believed that this increase in strength offsets the corresponding reduction in material thickness and, thus, also contributes to the resistance to buckling obtained through coining.

Thus, in a preferred embodiment of this invention applied to closures of an aluminum alloy (e.g., Aluminum Association Specification AA 5182), the amount of reduction in thickness by coining should range from about twenty-five to forty percent of the original material thickness. It should be understood that other metal alloys exhibiting different ductilities or different work-hardening characteristics may permit differing amounts of coining to achieve high strength without incurring unacceptable collateral effects.

Preferably, two areas of the outer surface of the closure are coined in separate cold-working operations. In the first operation, a first frustoconical coined surface is formed that includes a portion of the arcuate length of the center-panel ring and a portion of the outer surface of either the center panel or the inner leg.

In the second operation, a second frustoconical coined surface is formed that includes another portion of the arcuate length of the center-panel ring, and that may include a portion of the outer surface of the other adjoining portion. That is, if the first operation included a portion of the center panel, then the second operation may include a portion of the inner leg.

When certain coin angles are chosen, the coined surfaces overlap, so that the second coining operation reforms a portion of the first frustoconical coined surface to be a part of the second frustoconical coined surface. This reformed portion of the second frustoconical surface is hereafter referred to as a twice cold-worked perimetrical portion.

If widely varying coin angles are chosen, a portion of the uncoined center-panel ring remains between the two frustoconical coined surfaces. While using such coin angles does not achieve the maximum advantage of the twice cold-worked portion, a zone of intersecting strain fields is still observed in the metal beneath the coined surfaces and the strengthening advantages of such a zone or band are obtained. Furthermore, widely differing coin angles cold-work a greater portion of both the center panel and the inner leg, and achieve strength advantages thereby.

In a second preferred embodiment of the present invention, the cold-working produces a curvilinear surface, rather than two frustoconical coined surfaces. In the curvilinear embodiment, the curvilinear cold-worked surface follows the general contour of the product side of the closure, or generally follows the uncoined contour of the public side of the closure, or more preferably, leaves a generally uniform coin residual.

Curvilinear coining cold-works a cross-sectional area of material that is greater than that which is achieved, for a given coin residual, by either the prior art or the frustoconical coining embodiment of the present invention.

Also, curvilinear coining cold-works a cross-sectional area of material that is greater than that which is achieved, for a given curvilinear length of uncoined material, by either Nyugen or the frustoconical coining embodiment of the present invention.

It will be appreciated that such curvilinear coining in accordance with the subject invention is considered to create a zone or zones of intersecting strain fields.

The curvilinear coining of the present invention may be done in one or more steps, to achieve twice cold-worked areas, or to reduce the required per step press capacity.

It is a principal object of the present invention to increase the buckling strength that can be achieved in a container closure using a given thickness of metal, or alternately, to achieve the same buckling strength with a thinner material or with materials of lower strength.

It is an object of the present invention to increase the buckling strength of a container closure by cold-working portions thereof.

It is an object of the present invention to cold-work a greater curvilinear length of metal than has heretofore been achieved.

It is an object of the present invention to cold-work a greater cross-sectional area of material for a given coin residual than has heretofore been achieved.

It is a further object of this invention to utilize stock that has heretofore been used primarily for the body stock and includes aluminum and steel alloys.

It is an object of the present invention to cold-work a greater cross-sectional area for a given uncoined curvilinear length of metal than has heretofore been achieved.

It is an object of the present invention to increase the buckle resistance of closures by subjecting an end having a central-panel ring by cold-working first and second portions of the arcuate length of the convex surface of the center-panel ring in first and second coining steps.

It is an object of the present invention to increase the buckle resistance of an end closure by cold-working a first portion of the arcuate length of the center-panel ring and an adjoining portion of the center panel in one coining operation, and to cold-working another portion of the arcuate length of the center-panel ring and an adjoining portion of the inner leg in another coining operation.

Finally, it is an object of the present invention to substantially enhance the strength characteristics of a metal closure by cold-working a first portion of the arcuate length of the center-panel ring and an adjoining portion of the center panel in one coining operation, to cold-work the remainder of the arcuate length of the center-panel ring and an adjoining portion of the inner leg in another coining operation, and to cold-work an arcuate portion of the center-panel ring in both coining operations.

The aforementioned objects are achieved by providing a metal closure with an inner closure portion, an outer closure portion circumscribing said inner closure portion and being spaced outwardly therefrom, and a curved ring circumscribing said inner closure portion, said curved ring being interposed between and integral with said inner and outer closure portions, coining a first face by forming a first planar surface in said curved ring, and coining a second fact by forming a second planar surface juxtaposed with and overlapping an area on the first planar surface. From the outer point of view, the aforementioned objects are achieved by providing a metal closure with an inner closure portion, an outer closure portion circumscribing said inner closure portion and being spaced outwardly therefrom, and a curved ring circumscribing said inner closure portion, said curved ring being interposed between and integral with said inner and outer closure portions, and forming a band of intersecting strain fields in said curved ring to provide strengthening member circumscribing said inner closure portions.

The aforementioned objects are further achieved by the method of strengthening the metal closure, said closure having a substantial textured structure in cross section, said metal closure being provided with a curved annular ring, said method of strengthening comprising cold working the curved annular ring of the closure in more than one direction to provide a band of intersecting deformations thereby altering the texture and continuity of the structure.

The article of manufacture of the subject invention is a metal closure comprising an inner closure portion, an outer closure portion circumscribing said inner closure portion and being spaced outwardly therefrom, a curved ring circumscribing said inner closure portion, said ring being interposed between and integral with said inner and outer closure portions, said curved ring having a band of intersecting strain fields.

DESCRIPTION OF THE PREFERRED EMBODIMENTS

Figure 1:
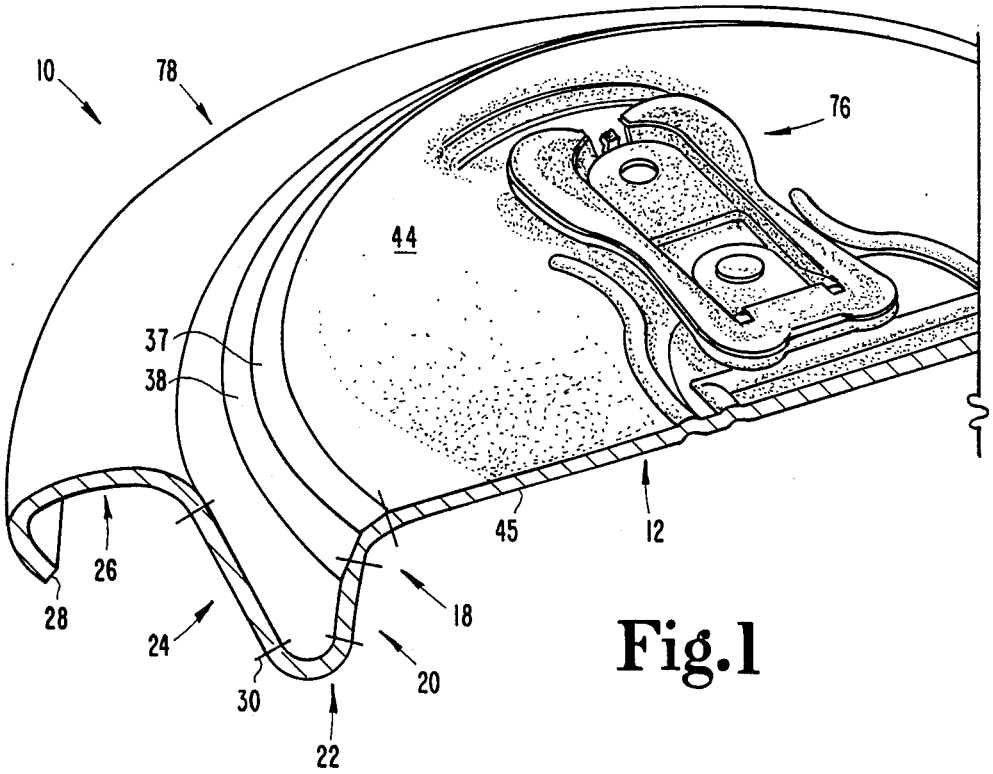
FIG. 1 is perspective view of a metal closure made in accordance with a first embodiment of the present invention.
Figure 2:
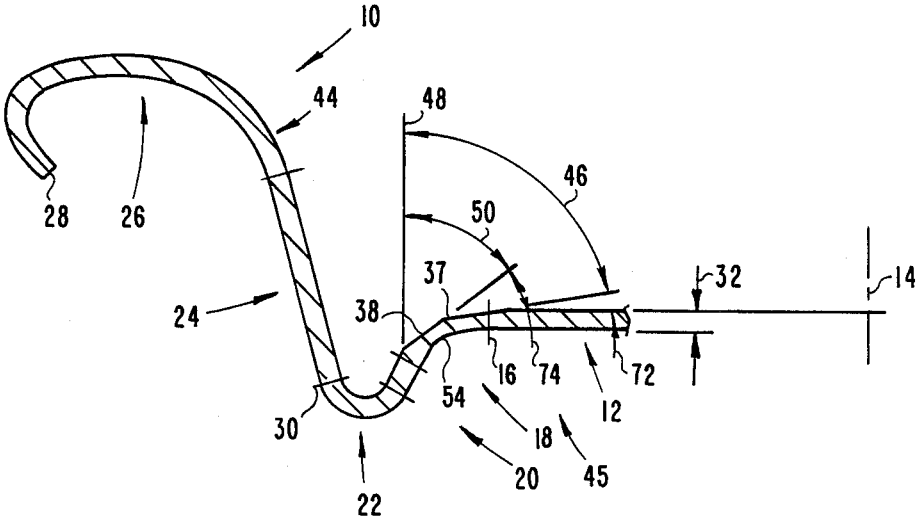
FIG. 2 is an enlarged and partial cross sectional elevation of the metal closure of FIG. 1 showing the two frustoconical coined surfaces in cross section.

Referring now to the drawings, and more particularly to FIGS. 1 and 2, a container closure, or metal closure, 10 includes a center panel, or inner closure portion, 12 that is disposed orthogonally to a container axis 14 and that includes a circular perimeter 16, a center-panel ring, or curved ring 18 that is integral with the center panel 12 and that curves downward from the circular perimeter 16, a circular inner leg, or outer closure portion, 20 that is integral with the center-panel ring 18 and that depends downwardly therefrom, a curved connecting portion 22 that is integral with the inner leg 20 and that includes an inner radius 23, a circular outer leg 24 that is integral with the connecting portion 22 and that extends upwardly therefrom, and an outer curl 26 that is integral with the outer leg 24 and that includes a peripheral outer edge 28.

Since portions of the container closure 10 have been named and numbered that are integral with one another, phantom lines 30 are included to show where individual ones of the above-named parts terminate and join to adjacent ones of the above-named parts.

Figure 3:
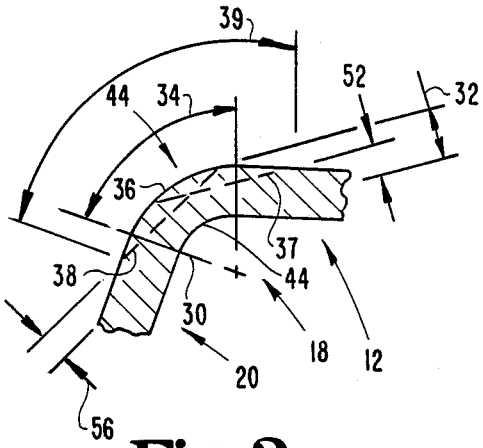
FIG. 3 is an enlarged cross section of a portion of the center-panel ring of FIG. 2, taken substantially the same as FIG. 2, and showing the coined surfaces by phantom lines.

Referring now to FIGS. 2 and 3, the metal closure 10, including the center-panel ring 18 thereof, has an uncoined thickness 32; and the center-panel ring 18 has an uncoined arcuate length 34 which includes all of an uncoined convex curved surface 36.

Frustoconical coined surfaces, 37 and 38 are shown by phantom lines 30 in FIGS. 3–6. In the example of FIG. 3, the two coining steps of the frustoconical coined surfaces 37 and 38 include a total uncoined curvilinear length 39 which is greater than the uncoined arcuate length 34 of the center-panel ring 18, although such is not the case for all combinations of coining angles.

Figure 6:
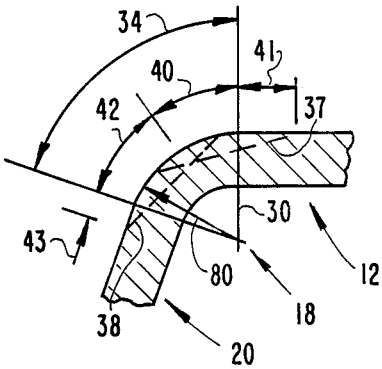
FIG. 6 is yet another duplication of the center-panel ring of FIG. 2, included herein to facilitate numbering and describing the present invention.

Referring now to FIG. 6, the frustoconical coined surface 37 includes a perimetrical portion, or uncoined arcuate length, 40 of the center-panel ring 18, and a perimetrical portion, or uncoined length 41 of the center panel 12.

The frustoconical coined surface 38 includes a perimetrical portion, or uncoined arcuate length, 42 of the center-panel ring 18, and a perimetrical portion, or uncoined length 43 of the inner leg 20.

Referring now to FIGS. 1 and 2, the metal closure 10, including the center panel 12, the center-panel ring 18, the inner leg 20, the curved connecting portion 22, the outer leg 24, and the outer curl 26, along with all of the above-named portions thereof, includes a public side, or outside, 44, and a product side, or inside 45.

The frustoconical coined surface 37 is disposed at a cone angle 46 with respect to both a parallel axis 48 and the container axis 14., and the frustoconical coined surface 38 is disposed at a cone angle 50 with respect to both the parallel axis 48 and the container axis 14. It can be seen in FIG. 2 that both the cone angle 46 and the cone angle 50 intercept the axis 14 on the public side 44 of the closure 10.

Referring again to FIG. 3, the center-panel ring 18 is coined to a coin residual 52 which is the thickness of metal between the frustoconical coined surface 37 and a concave curved surface 54 of the center-panel ring 18., and the center-panel ring 18 is coined to a coin residual 56 which is the thickness of metal between the coined surface 38 and the concave curved surface 54.

Figure 4:
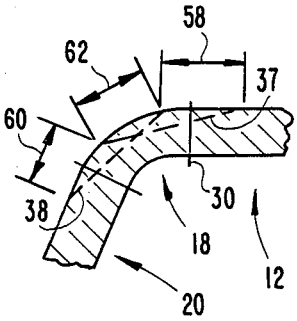
FIG. 4 is a duplication of the view of FIG. 2, included herein to facilitate numbering and describing various features of the present invention.

Referring now to FIGS. 2–4, and more particularly to FIG. 4, the total uncoined curvilinear length 39 of the closure 10 which is coined into the surfaces 37 and 38 includes a first perimetrical portion 58, a second perimetrical portion 60, and, in the example shown, a third perimetrical portion, or twice cold-worked portion, 62. It can be appreciated that the twice cold-worked portion defines a band of intersecting strain fields in the metal between and beneath the two cold-worked surfaces.

Figure 5:
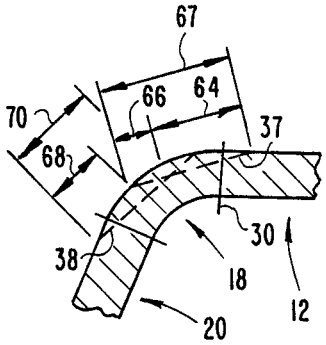
FIG. 5 is another duplication of the center-panel ring of FIG. 2, included herein to facilitate numbering and describing the present invention.

Referring now to FIG. 5, considering for purposes of illustration that the frustoconical coined surface 37 is produced first, although the actual order of the coining steps may be selectively determined, then the material that is cold-worked in the first coining step includes a cold-worked perimetrical area, or perimetrical portion, 64 and a twice cold-worked perimetrical portion 66, which together form a perimetrical area, or perimetrical portion 67.

The second cold-working step includes coining, or cold-working, a perimetrical portion 68, reforming, or recoining, the perimetrical portion 66 to be a part of the frustoconical coined surface 38, and forming a cold-worked perimetrical area, or perimetrical portion, 70 which includes both the perimetrical portion 68 and the perimetrical portion 66.

Thus, if the frustoconical coined surface 37 is produced first, the perimetrical portion 66 is twice cold-worked originally being a part of the frustoconical coined surface 37, and being reformed to a part of the frustoconical coined surface 38.

However, as the difference between the cone angles 46 and 50 is increased, the overlap between the perimetrical portions 67 and 70 will decrease, and the twice cold-worked portion 66 will decrease. It is obvious by studying the illustration of FIGS. 2 and 5 that if the difference between the cone angles 46 and 50 is increased sufficiently, there will be a portion, not shown, between the perimetrical portions 67 and 70 that is not coined. It will be appreciated that although the portions that are coined are separate, the associated strain fields extend outwardly and do intersect though the zone of the intersection decreases in size as the separation increases.

Testing of the present invention included varying the cone angle 46 of the frustoconical coined surface 37 from 90 to 52 degrees, or varying a coin angle 72 from 0 to 38 degrees, as measured from the public side 44 of the center panel 12.

Also, testing included varying the cone angle 50 of the frustoconical coined surface 38 from 30 to 75 degrees, or varying a coin angle 74 from 60 to 15 degrees, as measured from the public side 44.

The thickness 32 of the metal used in the tests (AA 5182 aluminum alloy) was 0,0113 inches (0.287 millimeters); and the coin residuals, 52 and 56, varied from 0.0045 inches (0.114 millimeters) to 0.0095 inches (0.241 millimeters).

Shells 78, or closures 10 without pull-tab openers 76, manufactured at one time and on one press and from the above-disclosed metal stock (0.0113 inch) were used for the tests., and the average buckling strength (measured using a Reynolds-type buckle testing apparatus) for these shells 78, without coining was 100.8 pounds per square inch (6.950 Bars) with a standard deviation of 1.95 pounds per square inch (0.134 Bars).

Single coining made according to the teaching of Nyugen (using the above-disclosed shells) produced an average buckling pressure of 112.3 pounds per square inch (7.74 Bars) with a standard deviation of 1.85 pounds per square inch (0.127 Bars).

Double frustoconical coining (using the above-disclosed shells), with a coin angle 72 of either 10 to 17.5 degrees, and with a coin angle 74 of 25 to 60 degrees, produced an average buckling strength in 36 tests of 10 containers each of 119.4 pounds per square inch (8.230 Bars) with an average standard deviation of 1.95 pounds per square inch (0.134 Bars).

Thus, the average gain in buckling pressure of containers with double frustoconical coining was 18.6 pounds per square inch (1.28 Bars) over uncoined shells and 7.1 pounds per square inch (0.490 Bars) over shells coined according to the teaching of Nguyen.

These results also indicated that it is possible to obtain larger increases in buckle strength while cold-working less material through the use of the double coin as opposed to the use of a single coin. The increase in buckle strength obtained through coining is known to vary directly with the amount of cold-work applied. Such cold-work has been quantified by approximating the cross-sectional area of the metal displaced when the coined surface or surfaces are formed.

Figure 10:
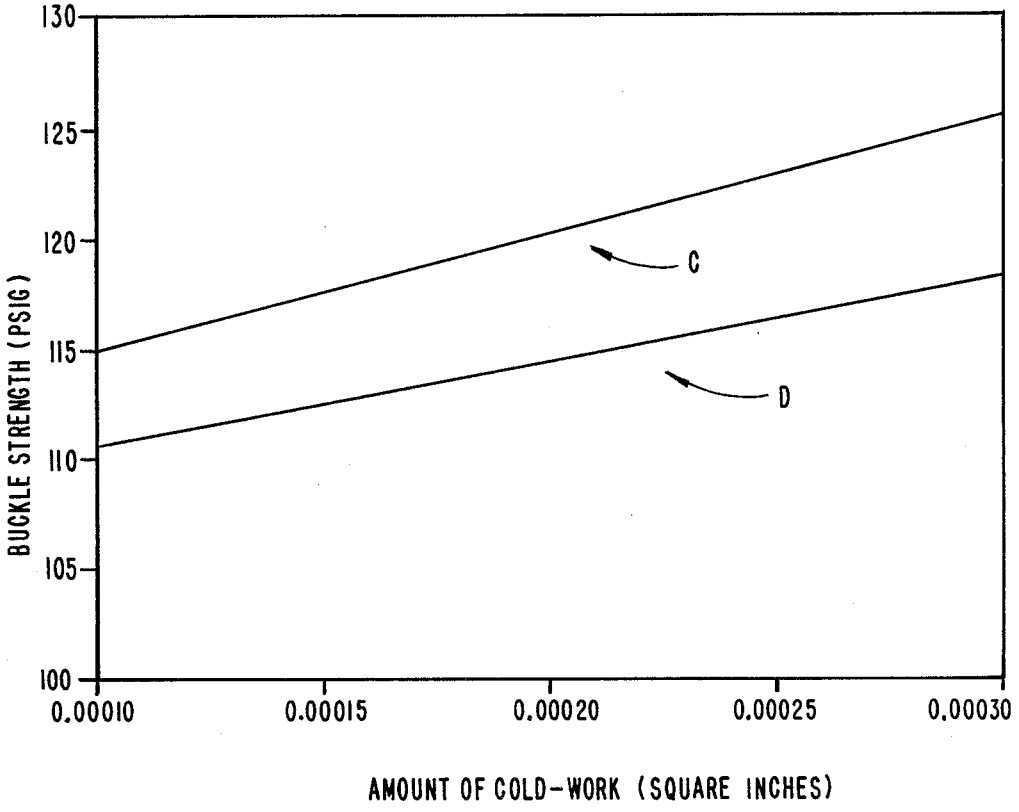
FIG. 10 is a graph of buckle strength (psig) vs. amount of cold-work (square inches) when slope C is a plot of double coined metal closure (in accordance with the subject invention) and slope D is a single coined plot.

FIG. 10 is a plot of the results of least-squares linear regression for buckle strength as a function of the approximate amount of metal cold-worked by applying either a single coin (slope D) or a double coin (slope C) to closures, as disclosed above. It was found that, for equivalent amounts of cold-work, the increase in buckle strength obtained using the double frustoconical coin was 43% greater than that obtained using the single coin, and that this result is significant at a confidence level of 95%.

A sample of the above disclosed closures were treated with two coins having the same coin angle 72. For such closures no increase in buckle strength was observed in comparison with identical closures treated with a single coin of the same coin angle and final coin residual 52.

The above results indicate that the mechanisms by which the double coin provides strength benefits are fundamentally different than those of the prior art and that by coining at more than one angle (i.e., in more than one direction) a synergistic and beneficial effect is obtained with respect to buckle strength.

Another significant increase in strength as gained by the present invention is seen in the increase of buckling strength vs. the dome depth of the center panel 12.

It is known that an increase in buckling strength can be achieved by increasing the dome depth. However, the amount of dome depth that is allowable is limited by a tab-over-chime problem. That is, there is a maximum allowable dome depth that can be used without the pull-tab opener 76 extending upwardly above the remainder of the container, thereby presenting problems in automation.

With containers coined with two frustoconical coined surfaces, the ratio of increase of buckling strength to increase in dome depth was 26.7 percent greater than for containers cold-worked according to the teaching of Nyugen.

Figure 9:
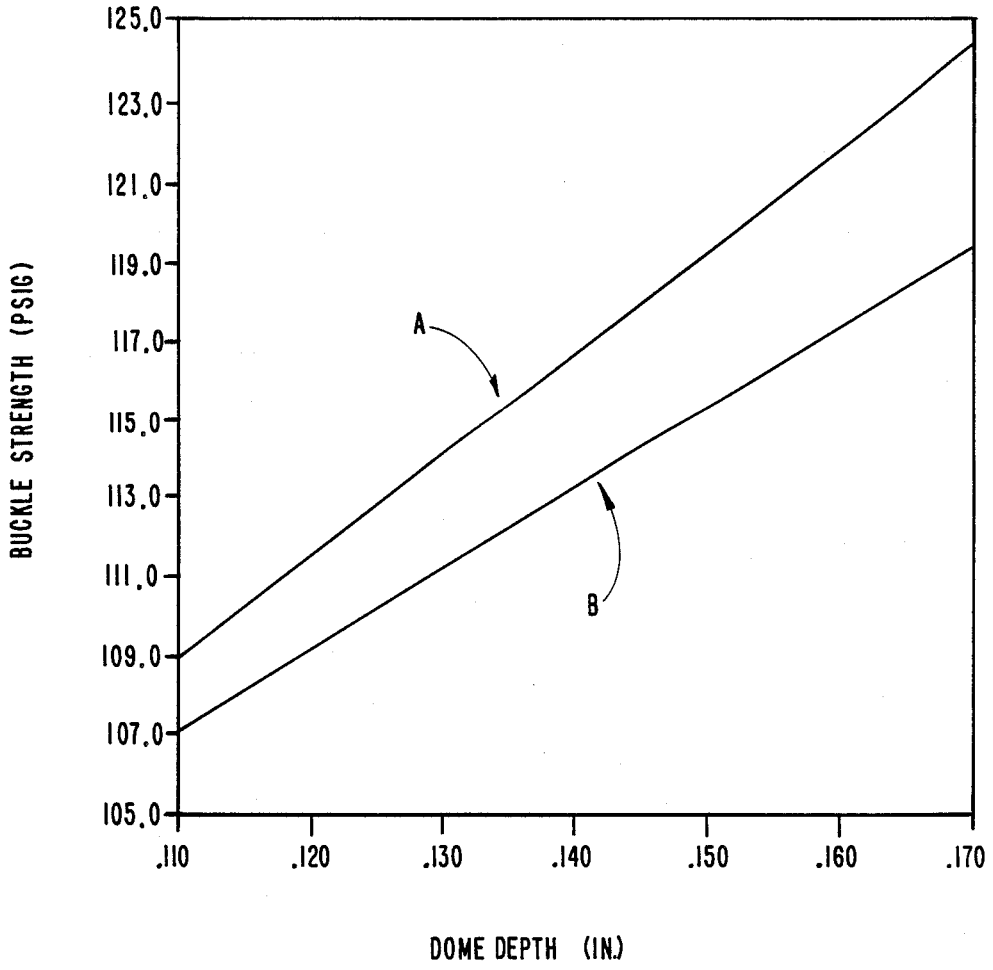
FIG. 9 is a graph of buckle strength vs. dome depth where slope A is a plot of double coined metal closure and slope B is a single coined plot.

These relations are illustrated in FIG. 9, which is a plot of the results of a least-squares linear regression analysis of empirical data obtained for closures treated according to the teachings of Nguyen and for closures treated with the double frustoconical coin. Analysis of variance of these two sets of data indicates that the benefits obtained through the use of the double frustoconical coin over those obtained following the teachings of Nguyen are significant at a confidence level of 97.5%.

Also associated with the tab-over-chime problem is a limitation in the amount of bulging of the center-panel area when the closure is subjected to fluid pressure on the product side. Such bulging is quantified by double-seaming a closure onto a typical metal container, pressurizing said container, and measuring the displacement of the pull tab opener 76 as a function of internal pressure. In order to avoid problems in conveying it is desirable that the pressure at which the critical amount of bulging is reached be as high as possible.

In tests conducted using closures 10 with pull tab openers 76 and other opening features and manufactured of 5182 aluminum alloy the double frustoconical coin was found to confer resistance to bulging superior to that obtained by the prior art. If, for example, 0.100 inches is chosen as the maximum allowable displacement of the pull tab, closures treated according to the teachings of the aforementioned patents by Nguyen were found to exceed this value at 10 psig less than identical closures treated using the double frustoconical coin.

Additionally, closures 10 with pull tab openers 76 and other opening features were manufactured from two samples of 5182 metal stock having thicknesses of 0.0100" and 0.0104", respectively, using standard production presses to add the opening features. A portion of these closures were treated with a double frustoconical coin according to the present invention, with one cone angle of 80°, or a coin angle of 10°, and another cone angle of 52°, or a coin angle of 38°, each coining having coin residuals 52 and 56 of approximately 0.0070". Another portion of the above disclosed closures were not treated by coining. Closures treated with the above disclosed double frustoconical coin exhibited buckling strengths an average of 15.6 psig (with a standard deviation of 2.2 psig) greater than those of uncoined closures manufactured of like material thickness. Closures treated with a single coin according to the teachings of Nguyen are known to exhibit an increase of buckling strength not in excess of 5 to 7 psi over uncoined closures.

Therefore, even though the testing thus far has been insufficient to optimize the increases in buckling pressures, the increases that have been achieved thus far, together with the small standard deviations which are involved, demonstrate that a significant improvement in buckling pressures, and/or a decrease in metal thickness can be achieved by the present invention.

The material most commonly used in the manufacture of metal beverage container closures is Aluminum Association Specification AA 5XXX (where X represents integer, zero to nine) series of aluminum alloys. This series of alloys is characterized by a solid solution of alloying elements (primarily magnesium) which confers a strength higher than that of unalloyed aluminum. The AA 5XXX series alloys are high-strength alloys and exhibit high work-hardening rates.

The aluminum alloys most commonly used for the manufacture of drawn and ironed beverage containers are of the AA 3XXX series. These alloys contain manganese and are strengthened primarily by the formation of second phase precipitate particles. Alloys of this series are, in general, less strong but more formable than those of the AA 5XXX series and generally exhibit lower rates of work hardening.

Figure 7:
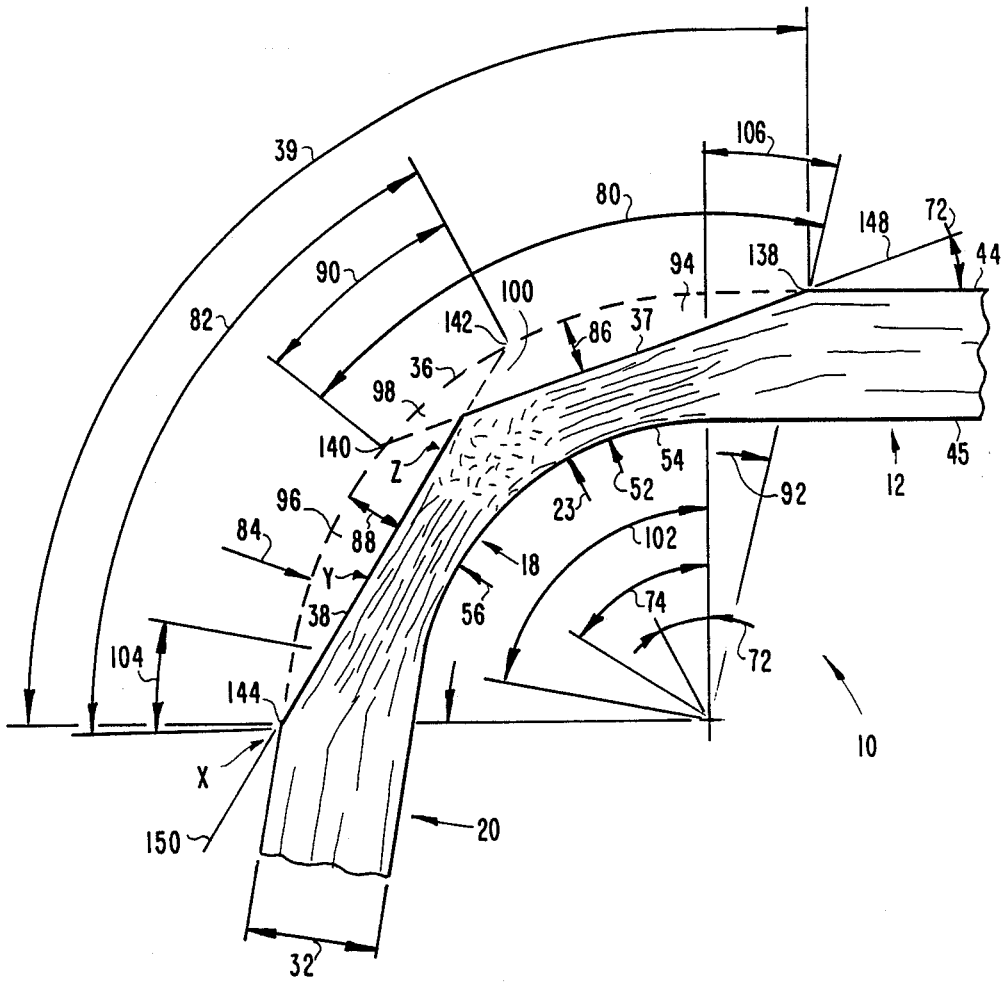
FIG. 7 is an enlarged cross sectional elevation of the embodiment of FIG. 1 showing a schematic representation of the texture of metal as well as the dimensions for use in describing mathematical calculations included herein.

Various steel alloys have been used to manufacture both drawn and ironed containers and closures for such containers. Steel is solid solution strengthened through the addition of carbon to iron and is characterized by a wide range of mechanical properties, depending on the composition of the alloy and the thermal and mechanical treatment to which it is subjected. The test results disclosed above involving both solid solution and precipitation strengthened alloys indicate that the present invention is applicable to each category of such alloys. Referring now to FIG. 7, for a better understanding of the various mathematical relationships that are involved, the angle, 80 or 82, that is subtended in one frustoconical cold-worked surface is:

$$\alpha=2\cos^{-1}([R_o-h]/R_O)$$

where:

$R_o$=uncoined outer radius 84 of the center-panel ring h=max. depth of cold working, or chord height, 86 or 88

The angle of overlap, or double coining, 90 of two frustoconical cold-worked surfaces 37 and 38 is:

$$\alpha_d=\theta_1-\theta_2+\alpha_1/2+\alpha_2/2$$

where:

$\theta_1$=the smaller coin angle 72

$\theta_2$=the larger coin angle 74

$\alpha_1$=angle subtended by coin angle 72

$\alpha_2$=angle subtended by coin angle 74

If $\alpha_1$ and $\alpha_2$ overlap, the total angle 92 that is subtended by the two frustoconical coined surfaces 37 and 38 is approximately:

$$\alpha_t=\theta_2-\theta_1+\alpha_2/2+\alpha_1/2$$

The total uncoined curvilinear length 39 of the closure 10 that is cold-worked is very nearly equal to:

$$L=R_o\alpha_t$$

where $\alpha_t$ is the total angle 92, in radians, that is subtended by cold-working.

The cross-sectional area, 94 or 96, of a single frustoconical cold-worked surface, 37 or 38, is:

$$A_f=R_o^2\cos^{-1}([R_o-h]/R_o)-(R_o-h)\sqrt{2R_oh-h^2}$$

where the angle of the arc cosine is in radians

The overlapped, or double coined, area 98 of the cross-sectional areas 94 and 96 is:

$$A_d=R_o\cos^{-1}(R_o-h_o/R_o)-(R_o-h_o)\sqrt{2R_oh_o-h_o^2}+[(R\sin\alpha_d/2)][2\tan(\theta_2/2-\theta_1/2)]$$

where:

$h_o=R_o(1-\cos\alpha_d O/2)$, and the angle of the arc cosine is in radians.

And, it can be seen by inspection of FIG. 7 that the total, or net, cross-sectional area 100 that is coined by the cross-sectional areas 94 and 96 is equal to the sum of the cross-sectional areas 94 and 96 subtracted by the overlapped area 98.

Using the formulas given above the total uncoined curvilinear length 39 that is produced by two frustoconical coined surfaces, 37 and 38, is 23.9 percent greater than is produced by a single frustoconical coined surface, 37 or 38, for a given coin residual, 52 or 56, when the coin angles, 72 and 74, differ by only fifteen degrees. Thus, more of the material can be cold-worked than can be achieved by a single frustoconical coin, even with such a small difference in the coin angles, 72 and 74.

Of even greater significance, the total cross-sectional area 100 that is cold-worked by two frustoconical coined surfaces, 37 and 38, is 33.9 percent greater than is produced by a single frustoconical coined surface, 37 or 38, when the coin angles, 72 and 74, differ by only fifteen degrees.

Referring finally to FIG. 7, the inner leg 20 bends downward by an angle 102, the angle 104 illustrates the material of the inner leg 20 that is coined, and the angle 106 illustrates the material of the center panel 12 that is coined.

Figure 8:
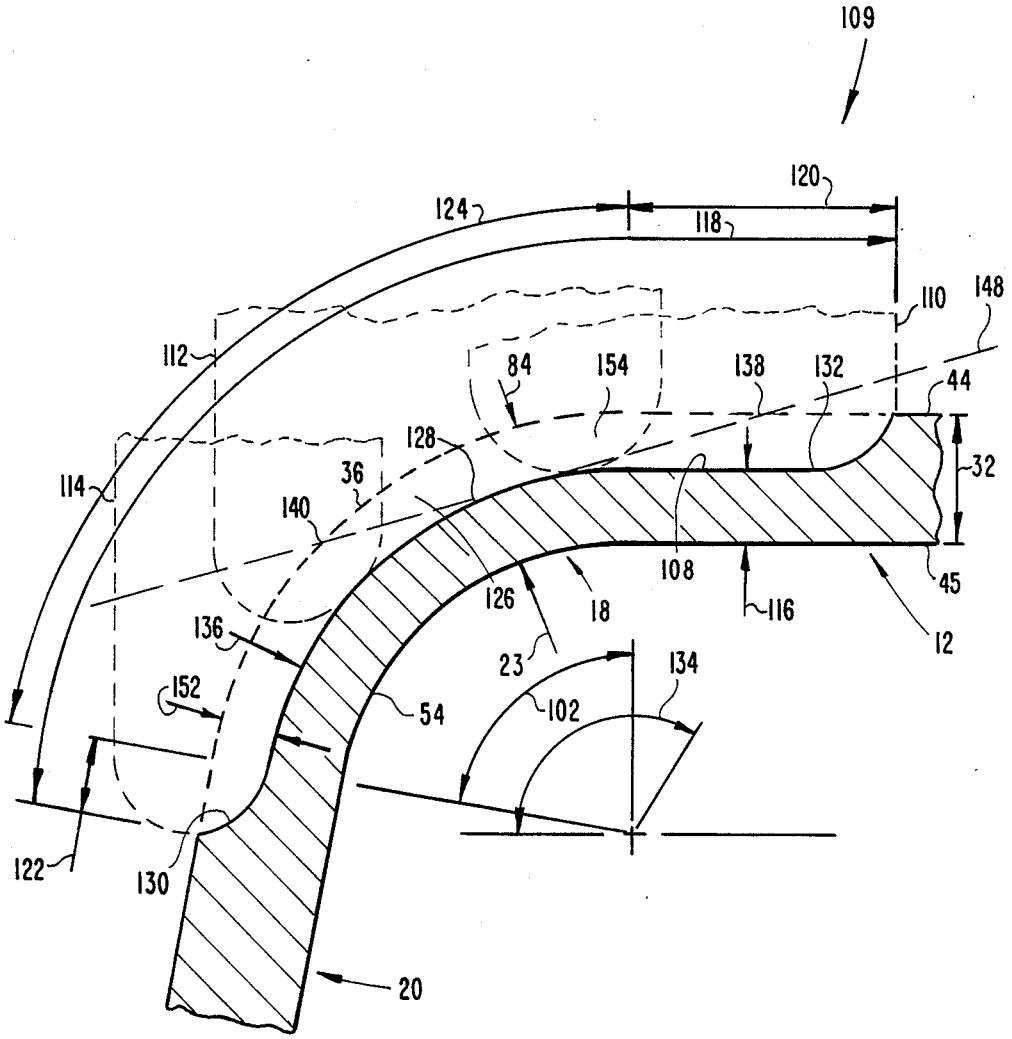
FIG. 8 is an enlarged cross sectional elevation of an embodiment of the present invention in which curvilinear cold-working is provided.

Referring now to FIG. 8, in a second preferred embodiment of the present invention, a curvilinear coined surface, or cold-worked surface, 108 is produced on the public side 44 of a metal closure, or container closure, 109. The curvilinear coined surface 108 may be produced by one or more coining tools, such as the coining tools 110, 112, and 114. It is to be noted that in curvilinear coining as implied herein that the die tool surface or surfaces that is to be brought to bear on the curved ring portion of the metal closure is curved in design.

The curvilinear coined surface 108 produces a coin residual 116 that is generally constant. A total uncoined curvilinear length 118 of the curvilinear coined surface 108 includes a curvilinear uncoined length, or radial portion, 120 in the center panel 12 and a curvilinear uncoined length, or radial portion, 122 in the inner leg 20 as well as including a curvilinear length, or portion, 124 in the center-panel ring 18.

The curvilinear coined surface 108 includes a total cold-worked cross-sectional area 126 which includes a first cold-worked perimetrical portion, or first perimetrical area, 128 in the center panel 12, a second cold-worked perimetrical portion, or second perimetrical area 130 in the inner leg 20, and a third cold-worked perimetrical portion, or third perimetrical area, 132 in the center-panel ring 18.

The total cold-worked cross-sectional area 126 that is displaced by the curvilinear coined surface 108 can be approximated by the following formula:

$$A=\tfrac{1}{2}\theta_t(R_o^2-R_r^2)$$

where:

$\theta_t$ is the total angle 134 subtended by curvilinear coining $R_r$ is the radius 136 of the curvilinear coined surface 108

Using the formula given above, and with the same coin residual 116 as used for the coin residuals 52 and 56 for the preceding calculations, the total cross-sectional area 126 of curvilinear coining is 61 percent greater than is achieved with a single frustoconical coined surface, 37 or 38, and is 49 percent greater than is achieved with two frustoconically coined surfaces, 37 and 38, when the surfaces 37 and 38 are separated by the same angle as used for the previous calculations.

In summary, the first embodiment of FIGS. 1–7 provides first and second coined surfaces 37 and 38 by cold-working the surfaces. The depth of coining varies from a maximum at the depths 86 and 88, to zero at radially-spaced locations 138, 140, 142, and 144 where chords 148 and 150 intercept the outside 44.

As noted above, the first embodiment of the present invention, achieves a significant increase in the buckling pressure, and achieves a significant increase in the ratio of increase in buckling strength vs. dome height.

The first embodiment, with the frustoconical coined surfaces, 37 and 38, thereof, coins a significantly greater total uncoined curvilinear length 39 of the metal closure 10 than a single frustoconical coined surface, 37 and 38, that is defined by a chord, 148 or 150, that is spaced from the product side 45, and that intercepts the public side 44 at radially spaced locations, 138 and 140, or 142 and 144.

And finally, the first embodiment of the present invention coins a significantly greater cross-sectional area 100 for a given coin residual, 52 or 56, than the cross-sectional area, 94 or 96, of a single frustoconical coined surface, 37 or 38.

The initial deformation made on the curved ring portion is followed by or concurrent with a second deformation which is generally overlapping the initial one or may be slightly spaced therefrom. The upper coined angle may be, for example, from 0° to above 45°, the lower from above 5° to 90° as measured from the horizontal. The amount of overlap or contact between the coined surfaces can be from about 0 to 95%, preferably about 20 to 40%.

The second embodiment of FIG. 8 cold-works a curvilinear coined surface 108 which: has a greater curvilinear length 118 than can be achieved by coining a single frustoconical coined surface, 37 or 38, has a generally constant coin residual 116, has a generally constant depth of cold-working 152, has a total cold-worked cross-sectional area 126 that is considerably greater than the cross-sectional area, 94 or 96, that is produced by a single frustoconical coined surface, 37 or 38, and has a total cold-worked cross-sectional area 126 that is greater than the total cross-sectional area 100 that is produced by cold-working two frustoconical coined surfaces, 37 and 38. More importantly, the curved ring portion that has been cold-worked by curvilinear coining provides a wide zone or zones of intersecting strain fields.

FIG. 8 usually illustrates the fact that the total cold-worked cross-sectional area 126 for curvilinear coining, in the example quoted, is 61 percent greater than a cross-sectional area 154 that lies between the uncoined convex curved surface 36 and the chord 148 that intercepts the uncoined curved surface 36 at the radially-spaced locations 138 and 140.

It is common practice to form the shells 78 in a shell press which blanks and forms the basic shape from sheet metal stock. The partially completed shell 78 is then transferred to a conversion press where the opening features, as well as the rivet which holds the pull-tab opener 76, are formed.

The conversion press is a multi-station press. Each of the shells 78 is advanced progressively to new tooling wherein additional operations are performed. It is contemplated that as many as three coining operations, as shown in FIG. 8, can be performed in the general area of the center-panel ring 18, and that the resultant strength can be greater than has resulted from tests that included only two coining operations.

A preferred material for the closures 10 is aluminum alloy AA 5182; although other aluminum alloys, such as AA 3004 and other metals, such as steel, may be used with the process described herein.

Preferably, the process is performed on a closure 10 for attachment to a container having sidewalls, however, it is equally suitable for use on an integral end of a container.

While specific apparatus has been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to metal closures for containers, and more particularly, the present invention is applicable to metal closures for containers, such as beverage containers.

What is claimed is:

1. A metal closure which comprises an inner closure portion, an outer closure portion circumscribing said inner closure portion and being spaced outwardly therefrom, a curved ring circumscribing said inner closure portion, said curved ring being interposed between and integral with said inner and outer closure portions, said curved ring having at least one coined surface on said curved ring, said surface providing a band of intersecting strain fields.

2. A metal closure as recited in claim 1 where the band of intersecting strain fields is defined by separate coined surfaces.

3. A metal closure as recited in claim 2 wherein the separate coiled surfaces overlap to provide a zone of twice cold-worked metal.

4. A metal closure as recited in claim 1 wherein the metal is an aluminum alloy.

5. A metal closure which comprises:

an inner closure portion;

an outer closure portion circumscribing said inner closure portion and being spaced outwardly therefrom;

a curved ring circumscribing said inner closure portion, being interposed between said inner and outer closure portions, and being integral with said inner and outer closure portions;

a first cold-worked perimetrical area of said metal closure which includes a first perimetrical portion of said curved ring;

a second cold-worked perimetrical area of said metal closure which includes a second perimetrical portion of said curved ring; and one of said perimetrical areas includes on said curved ring a twice cold-worked perimetrical portion to form a zone of intersecting strain fields.

6. A metal closure as claimed in claim 5 in which one of said cold-worked perimetrical areas includes a perimetrical portion of one of said closure portions.

7. A metal closure as claimed in claim 5 in which said first cold-worked perimetrical area includes a perimetrical portion of said inner closure portion.

8. A metal closure as claimed in claim 5 in which said second cold-worked perimetrical area includes a perimetrical portion of said outer closure portion.

9. A metal closure as claimed in claim 5 in which said closure includes first and second sides;

said curved ring includes a concave curved surface on said second side of said closure; and one of said cold-worked perimetrical areas is on said first side of said closure.

10. A metal closure as claimed in claim 9 in which one of said cold-worked perimetrical areas includes a perimetrical portion of one of said closure portions.

11. A metal closure as claimed in claim 10 in which said first cold-worked perimetrical area includes a surface that is generally frustoconical in shape and that is disposed at a first coin angle; and said second cold-worked perimetrical area includes a surface that is generally frustoconical in shape and that is coined at a second coin angle.

12. A metal closure as claimed in claim 5 in which said closure includes first and second sides;

said curved ring includes a concave curved surface on said second side of said closure; and said cold-worked perimetrical areas are on said first side of said closure.

13. A metal closure which comprises:

a center panel being disposed orthogonally to a container axis, and having a perimeter;

an inner leg being disposed perimetrically around said center panel, and being spaced apart therefrom;

a center-panel ring being disposed perimetrically around said center panel, being interposed between said metal panel and said inner leg, curving from said center panel to said inner leg, and being integral with said center panel and said inner leg;

a first perimetrical area of said metal closure which includes a first perimetrical portion of said center-panel ring; and a second perimetrical area of said metal closure which includes a second perimetrical portion of said center-panel ring, said first and second perimetrical portions defining at least one coined surface on said center-panel ring to provide a band of intersecting strain fields.

14. A metal closure as claimed in claim 13 in which one of said perimetrical areas includes a twice cold-worked perimetrical portion.

15. A metal closure as claimed in claim 13 in which one of said perimetrical areas includes a peripheral portion of said center panel.

16. A metal closure as claimed in claim 13 in which one of said perimetrical areas includes a peripheral portion of said inner leg.

17. A metal closure as claimed in claim 13 in which one of said perimetrical areas of said closure includes a twice cold-worked perimetrical portion;

one of said perimetrical areas includes a peripheral portion of said center panel;

said first perimetrical area includes a surface that is generally frustoconical in shape and that is coined at a first coin angle; and said second perimetrical area includes a surface that is generally frustoconical in shape and that is coined at a second coin angle.

18. A metal closure as claimed in claim 13 in which said metal closure is an aluminum alloy selected from the group consisting of (a) solid solution of magnesium with aluminum and (b) phase precipitates containing manganese with aluminum.

19. A metal closure which comprises:

a first closure portion having a perimeter;

a second closure portion circumscribing said first closure portion and being spaced radially outward therefrom;

a curved ring being disposed perimetrically around said first closure portion, being integral with said first and second closure portions, having first and second sides, and having a concave curved surface on said second side that extends from said first closure portion to said second closure portion;

a cold-worked surface on said curved ring that defines a band of intersecting strain fields between said first side and said cold-worked surface, and that defines a coin residual between said second side and said cold-worked surface; and said cold-worked cross-sectional area is at least fifteen percent greater than an area between said first side and a chord that touches said coin residual and that intercepts said first side at two radially-spaced locations.

20. A metal closure as claimed in claim 19 in which said cold-worked surface includes first and second cold-worked portions.

21. A metal closure as claimed in claim 20 in which said cold-worked surface includes a portion that has been twice cold-worked.

22. A metal closure as claimed in claim 20 in which said cold-worked surface includes first and second generally frustoconical coined surfaces.

23. A metal closure as claimed in claim 20 in which said chord intercepts said first side of said closure in one of said closure portions.

24. A metal closure as claimed in claim 20 in which said cold-worked surface includes a portion that has been twice cold-worked, said cold-worked surface includes first and second generally frustoconical coined surface and a second generally frustoconical coined surfaces; and said chord intercepts said first side of said closure in one of said closure portions.

25. A metal closure as claimed in claim 19 in which said cold-worked surface comprises a curvilinear coined surface; and said curvilinear coined surface defines a coin residual with said second side of said metal closure that is generally constant.

26. A metal closure as claimed in claim 25 in which said cold-worked surface includes first cold-worked perimetrical portions.

27. A metal closure as claimed in claim 25 in which said cold-worked surface includes a radial portion of one of said closure portions.

28. A metal closure as claimed in claim 19 in which said metal closure comprises an aluminum alloy.

29. A metal closure as claimed in claim 28 wherein the metal alloy is Aluminum Association Specification AA 3XXX or AA 5XXX series alloys.

30. A metal closure which comprises:

a first closure portion having a perimeter;

a second closure portion circumscribing said first closure portion and being spaced radially outward therefrom;

a curved ring being disposed perimetrically around said first closure portion, being integral with said first and second closure portions, having first and second sides, and having a concave curved surface on said second side that extends from said first closure portion to said second closure portion; and a cold-worked perimetrical area on said curved ring that defines a coin residual and provides a zone of intersecting stain fields, and that includes a total uncoined curvilinear length of said first side of said closure that is at least fifteen percent greater than that which is defined by a coin that touches said chord residual and that intercepts said first side at two radially-spaced locations.

31. A metal closure as claimed in claim 30 in which said cold-worked perimetrical area includes first and second cold-worked perimetrical portions.

32. A metal closure as claimed in claim 31 in which said cold-worked perimetrical area includes a portion that has been twice cold-worked.

33. A metal closure as claimed in claim 31 in which said cold worked perimetrical area includes a first generally frustoconical coined surface that is coined at a first coin angle, and a second generally frustoconical coined surface that is coined at a second coin angle.

34. A metal closure as claimed in claim 31 in which said chord intercepts said first side of said closure in one of said closure portions.

35. A metal closure as claimed in claim 31 in which said cold-worked perimetrical area includes a portion that has been twice cold-worked;

said cold-worked perimetrical area includes a first generally frustoconical coined surface that is coined at a first coin angle, and a second generally frustoconical coined surface that is coined at a second coin angle; and said chord intercepts said first side of said closure in one of said closure portions.

36. A metal closure as claimed in claim 30 in which said cold-worked perimetrical area includes a curvilinear coined surface; and said curvilinear coined surface defines a coin residual with said second side of said metal closure that is generally constant.

37. A metal closure as claimed in claim 36 in which said cold-worked perimetrical area includes first and second cold-worked perimetrical portions.

38. A metal closure as claimed in claim 36 in which said cold-worked perimetrical area includes a perimetrical portion of one of said closure portions.

39. A metal closure as claimed in claim 30 in which said metal closure comprises an aluminum alloy having Aluminum Association Specification AA 3XXX or AA 5XXX series designations.

40. A metal closure which comprises:

a first closure portion having a perimeter;

a second closure portion circumscribing said first closure portion and being spaced radially outward therefrom;

a curved ring being disposed perimetrically around said first closure portion, being integral with said first and second closure portions, having first and second sides, and having a concave curved surface on said second side that extends from said first closure portion to said second closure portion; and a curvilinear coined surface on said first side of said curved ring, said curvilinear coined surface comprising a band of intersecting strain fields.

41. A metal closure as claimed in claim 40 in which said curvilinear coined surface defines a coin residual with said second side of said metal closure that is generally constant.

42. A metal closure as claimed in claim 40 in which said curvilinear coined surface includes first and second cold-working portions.

43. A metal closure as claimed in claim 40 in which said curvilinear coined surface includes a curvilinear uncoined length of one of said closure portions.

44. A metal closure as claimed in claim 40 in which said curvilinear coined surface defines a coin residual with said second side of said metal closure that is generally constant;

said curvilinear coined surface includes first and second cold-work portions; and said curvilinear coined surface includes a curvilinear uncoined length of one of said closure portions.

45. A metal closure of increased buckle resistance which comprises:

a center panel being disposed orthogonally to a container axis, and having a perimeter;

an inner leg being disposed perimetrically around said first closure portion panel, and being spaced apart therefrom;

a center-panel ring being disposed perimetrically around said center panel, being interposed between said center panel and said inner leg, being integral with said center panel and said inner leg, having first and second sides, and having a concave curved surface on said second side; and a cold-worked perimetrical area of said center-panel ring, which defines a zone of intersecting strain fields.

46. A method for making a metal closure having increased strength, which method comprises:

(a) providing a center panel that is disposed orthogonally to a container axis;

(b) providing a curved ring that is integral with said center panel, that is disposed perimetrically around said center panel, that includes a fist side with a convex curved surface, and that includes a second side with a concave curved surface;

(c) deforming a first perimetrical area of said metal closure, that includes a portion of said curved ring, toward a second perimetrical area of said metal closure; and (d) deforming said second perimetrical area of said curved ring toward said first perimetrical area of said metal closure to provide a zone of intersecting strain fields.

47. A method as claimed in claim 46 in which said second deforming step reforms a portions of said first perimetrical area.

48. A method of making a metal closure having increases strength, which method comprises deforming a first perimetrical area that includes a portion of the outer surface of a curved ring disposed perimetrically around a center panel of said metal closure, and deforming a second perimetrical area of said curved ring toward said first perimetrical area whereby portions of the perimetrical area overlap to provide an intermediate zone of twice deformed metal to provide a band of intersecting strain fields.

49. A method of claim 48 in which the deforming steps provide frustoconical surfaces.

50. A method of claim 48 in which the deforming steps provide a curvilinear surface.

51. A method for making a metal closure having increased strength, which method comprises providing a metal closure with an inner closure portion, an outer closure portion circumscribing said inner closure portion and being spaced outwardly therefrom, and a curved ring circumscribing said inner closure portion, said cured ring being interposed between and integral with said inner and outer closure portions, and cold-working the curved ring to form a band of intersecting strain fields in said curved ring to provide a strengthening member circumscribing said inner closure portion.

52. A method as recited in claim 51 in which the band in said forming step is formed by separate coining operations.

53. A method as recited in claim 51 in which the separate coining operations are performed to cause the overlapping thereof.

54. A method as recited in claim 51 in which the metal closure is made from Aluminum Association specification AA 3XXX or AA 5XXX series alloys.

55. A method for making a metal closure having increase strength, which comprises providing a metal closure with an inner closure portion, an outer closure portion circumscribing said inner closure portion and being spaced outwardly therefrom, and a curved ring circumscribing said inner closure portion, said curved ring being interposed between and integral with said inner and outer closure portions, coining a first face by forming a first planar surface on said curved ring, and coining a second face on said curved ring by forming an second planar surface juxtaposed with and overlapping an area of the first planar surface to provide a zone of intersecting strain fields.

56. A method as recited in claim 55 wherein the first and second face form angles between zero and about 90° as measured from the horizontal.

57. A method as recited in claim 55 wherein the amount of overlap between the coined faces is about zero to 95%.

58. A method of strengthening a metal closure having a substantial textured structure, said metal closure being provided with a curved annular ring, said method comprising cold-working the curved annular ring in more than one direction to provide a band of intersecting deformation on said curved annular ring thereby altering the continuity of the textured structure to provide a band of intersecting strain fields.

59. A method as recited in claim 58 wherein the cold-working provides substantially flat surfaces on said annular ring.

60. The article produces by the method of claim 58.

61. A metal closure as claimed in claim 13 in which said band of intersecting strain fields is disposed between said first and second perimetrical areas.

* * * * *